United States Patent [19]

Bourgeois et al.

[11] Patent Number: 4,750,884

[45] Date of Patent: Jun. 14, 1988

[54] BINDER BACKING FOR NOTEBOOKS

[75] Inventors: Thomas W. Bourgeois, Spring Park, Minn.; William D. Stuertz, Glenview, Ill.

[73] Assignee: American Trading and Production Corporation, Baltimore, Md.

[21] Appl. No.: 764,411

[22] Filed: Aug. 9, 1985

[51] Int. Cl.[4] ..... B42F 13/00; B42F 3/00

[52] U.S. Cl. ..... 402/75; 402/13

[58] Field of Search ..... 402/13–17, 402/31–33, 40–43, 36–39, 75, 68, 80 P, 80 R; 281/21 A, 21 R, 25 R

[56] References Cited

U.S. PATENT DOCUMENTS

| | | | |
|---|---|---|---|
| 643,380 | 2/1900 | Kendig . | |
| 940,345 | 11/1909 | Moore . | |
| 1,617,958 | 2/1927 | MacLean | 402/61 X |
| 2,804,872 | 9/1957 | Kraut | 402/34 |
| 3,154,281 | 10/1964 | Frank | 29/453 X |
| 3,606,557 | 9/1971 | Schade . | |
| 3,807,675 | 4/1974 | Seckerson et al. | 29/453 |
| 4,202,642 | 5/1980 | Sjöstedt | 402/68 |
| 4,269,530 | 5/1981 | Weber | 402/80 R |
| 4,340,317 | 7/1982 | Jahn . | |
| 4,484,830 | 11/1984 | Anderson . | |
| 4,588,321 | 5/1986 | Egly | 402/502 |

FOREIGN PATENT DOCUMENTS

| | | | |
|---|---|---|---|
| 1290602 | 3/1969 | Fed. Rep. of Germany | 248/74 A |
| 1400400 | 7/1975 | United Kingdom | 402/13 |

*Primary Examiner*—Paul A. Bell

*Attorney, Agent, or Firm*—Vidas & Arrett

[57] ABSTRACT

A stability unit used in combination with a three ring binder of the type having front and back covers hingedly mounted between a spine. A binder assembly including arcuate rings halves is mounted to either the spine or cover. The stability unit is mounted to either a spine, cover or both. The stability unit includes recesses adjacent each ring halve and is constructed and arranged such that a ring halve may be inserted therewithin past a resilient projection which provides a locking function. When locked, the binder may be positioned in an upright attitude.

7 Claims, 1 Drawing Sheet

BINDER BACKING FOR NOTEBOOKS

DESCRIPTION

1. Field of the Invention

This invention relates generally to loose-leaf binders having ring mechanisms and particularly to a stability unit mounted adjacent the ring mechanism for locking the ring mechanism to another planar surface of the loose-leaf binder.

2. Background of the Invention

Loose-leaf binders have a base spine and a pair of cover panels which are hingedly connected to the opposite sides of the spine. A ring mechanism is attached to either the spine or to one of the cover panels adjacent the spine. The ring mechanism includes split rings which are operated by toggle plate mechanisms disposed within a housing plate. The housing plate is attached to one of the planar surfaces of the loose-leaf binder.

In prior art loose-leaf binders such as the type shown in U.S. Pat. Nos. 3,263,687 to Weichert and 4,214,839 to Sheehan a paper-filled binder may be set on end on a shelf or a desk in a closed position or partially open. However, if the paper held between the binder rings were to shift slightly, the binder may fall open which may damage its contents. Ordinarily, such loose-leaf ring binders are normally stored either laying on the front or back cover or between bookends.

It is often desired to be able to review the materials within a loose-leaf binder when the binder is in a standing position since it takes up less desk space in such a position. However, with the devices available in the prior art, a binder may fall forward or backward off the desk which is highly undesirable. It is, therefore, an object of this invention to provide a simple, quick means of stabilizing binders such that they may be stored on end in either a closed or opened position.

BRIEF SUMMARY OF THE INVENTION

The invention consists of a loose-leaf binder having a stabilizing unit, and a stabilizing unit which may be readily added to conventional, loose-leaf ring binders.

The improved loose-leaf ring binder of the invention includes front and back covers, each being hingedly joined to an opposing edge of the spine. A toggle ring mechanism including at least two split rings operated by a toggle plate mechanism is secured to either the spine or either cover adjacent the spine by conventional means. The particular toggle mechanism selected may be of any suitable type of variety known in the art which upon movement of a lever actuator serves to snap the remaining halves of the rings open and closed.

The loose-leaf binder also includes a stability unit which includes a base mountable to the spine or cover adjacent the spine of the loose-leaf binder. The stability unit further defines at least one slotted recess which has a depth greater than and a width slightly greater than the diameter of the loose-leaf ring. At the top of each slotted recess, the width of the slot is slightly less than the diameter of the loose-leaf ring. The material forming the stability unit is formed from a resilient plastic which allows a ring to temporarily deform a slotted recess such that the ring may enter the slot. Once the ring is within the slot, it is retained within the slot since the outermost edges of the slot define a width less than the diameter of the ring.

Preferably, there is a slotted recess for each of the loose-leaf rings of the binder assembly. The stability unit allows the rings to be pushed within the recesses which temporarily deforms the plastic allowing the ring to slip within the widest portion of the recess. The plastic then rebounds to its normal position which locks the rings within the recess until sufficient pressure is applied to again deform the plastic enough to enable each ring to be pulled from its recess.

When the binder assembly is positioned on one of the covers adjacent the spine and the stability unit is attached to the spine, a ring mechanism may be locked to the spine. In this manner, the spine and cover are locked together at approximately right angles to each other. This provides a stable base for the loose-leaf binder and allows the binder to be positioned upright on a surface allowing the other cover to be opened so that a user can observe the contents of the loose-leaf binder while it is on end. If desired, the entire loose-leaf binder may be laid flat.

Alternatively, the stability unit may be attached to one of the covers adjacent the spine. When a binder assembly is attached to the opposing cover of the loose-leaf binder, the stability unit will function to lock the loose-leaf binder in a closed position by securing the front and back covers together.

If the loose-leaf binder assembly is attached to the spine and the stability unit is attached to a cover adjacent the spine, the interaction of the stability unit and the rings of the binder assembly will lock the cover to the spine which creates a stable base thereby allowing the loose-leaf binder to be used in an open, standing position.

Finally, a stability unit comprising a base and outswardly projecting members which include the slotted recesses as described above may be affixed to any conventional three-ring binder, modifying same.

BRIEF DESCRIPTION OF THE DRAWINGS

A detailed description of the invention is hereafter described with specific reference being made to the drawings in which.

DETAILED DESCRIPTION OF THE INVENTION

Figure 1:
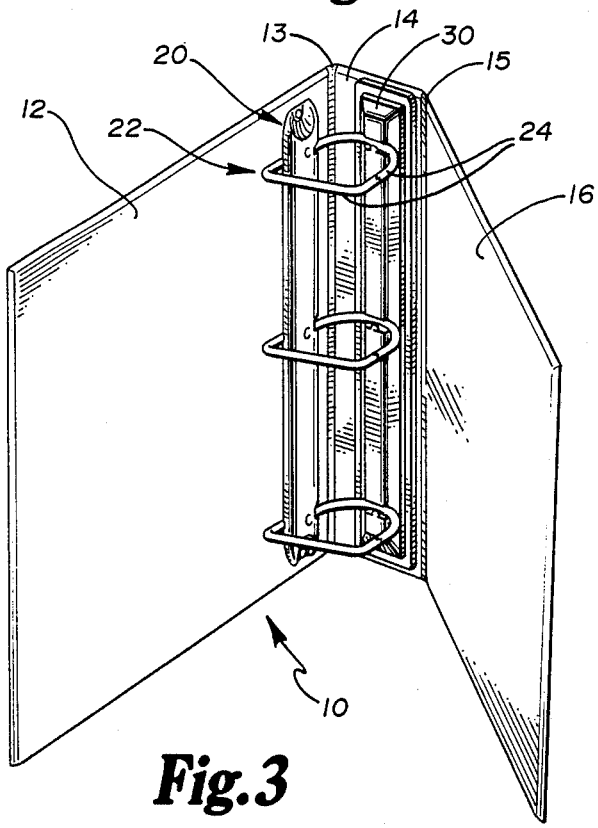
FIG. 1 is a perspective view of a three-ring binder with the rings locked to a stability unit positioned on a spine.
Figure 2:
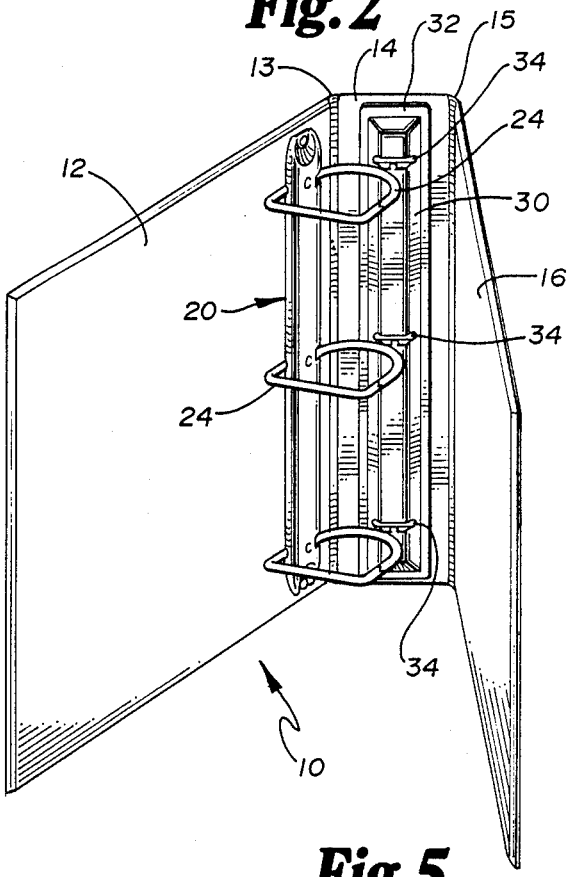
FIG. 2 is a perspective view of a three-ring binder in a released, unlocked position, the stability unit being secured to a cover.
Figure 3:
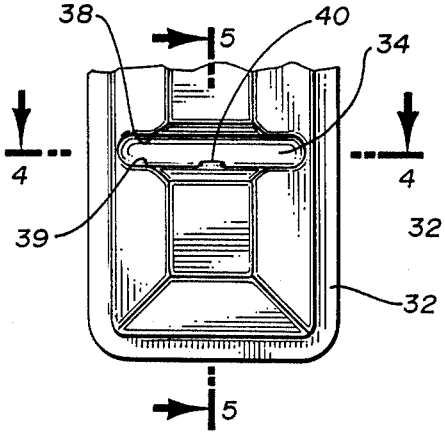
FIG. 3 is a front elevational view of the lower part of a stability unit.
Figure 4:
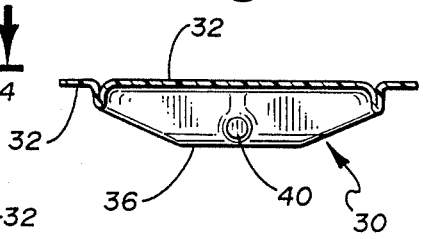
FIG. 4 is a top plan section taken along line 4—4 of FIG. 3.

With reference to FIG. 1, an improved loose-leaf binder 10 is shown having front cover 12, spine 14 and a back cover 16. Front cover 12 is joined to the spine by means of a flexible hinge 13 and the back cover is attached to the spine 14 by means of a similar flexible hinge 15. Although heat-sealed, vinyl cladded hinges are illustrated, it will be recognized that other types of hinges may be employed, if desired.

Loose-leaf binder 10 of FIG. 1 further includes binder assembly 20 affixed to back cover 16 adjacent to hinge 15. Binder assembly 20 includes spaced, leaf ring members 22 each composed of a pair of mating arcuate ring halves 24 which are pivotable with the binder assembly 20 between open and closed positions. Binder assembly 20 may be any conventional ring binder such as that shown and described in U.S. Pat. No. 3,263,687 to Weichert which is incorporated herein by reference.

A stability unit 30 is shown attached to spine 14 in FIGS. 1, 2, 6 and 7. Stability unit 30 may be formed of a plastic such as polyvinyl chloride. It is preferably attached to loose-leaf binder 10 by RF welding or adhesives. Stability unit 30 is preferably formed of plastic which may be formed by vacuum molding to include a base 32 mountable to binder 10 and recesses 34 within the upper surface 36.

Recesses 34 include a pair of side walls 38, 39 which are spaced apart slightly more than the diameter of arcuate ring halves 24. Stability unit 34 further includes at least one projection 40 extending from the top of recess 34 on a side wall toward the other side wall. The distance between the projection 40 and its opposing wall is slightly less than the diameter of arcuate ring halves 24.

A ring halve 24 pressed into recess 34 deforms projection 40 temporarily and enters the lower portion of the recess. The resilient nature of the stability unit material causes projection 40 to rebound, holding ring 24 within the recess.

Figure 5:
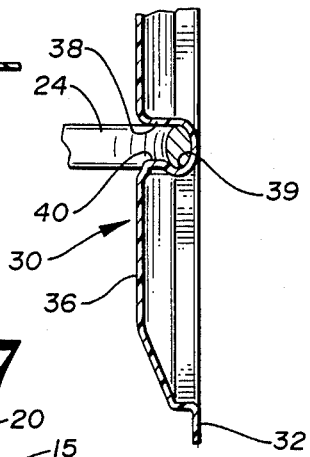
FIG. 5 is a vertical cross-section taken along line 5—5 of FIG. 3 with a ring locked in place.

As shown in FIG. 5, a ring halve 24 sits deep within recess 34 of stability unit 30 such that projection 40 rebounds to its original shape, trapping ring halve 24 therewithin. When a stability unit 30 is secured to a spine 14, the ring halves 24 may be locked to the stability unit 30 within the recesses 34. The binder 10 may then be positioned upright and open as shown in FIG. 1. Spine 14 and front cover 12 are locked together at roughly right angles forming a stable base regardless of the position of back cover 16. Due to stability unit 30, paper within binder 10 may be viewed in the position shown in FIG. 1. Binder 10 will not collapse forwardly damaging the loose-leaf paper sheets when the rings are locked to the stability unit.

Figure 6:
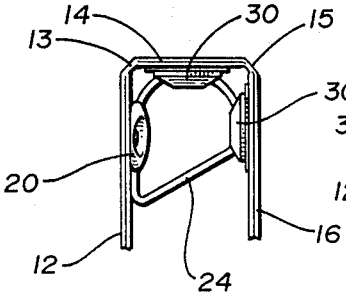
FIG. 6 is a top plan view of an alternative embodiment.
Figure 7:
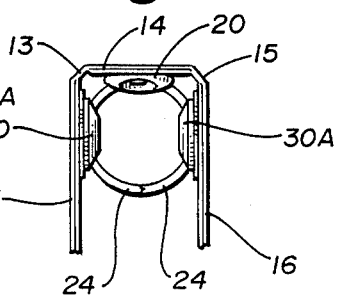
FIG. 7 is a top plan view of a further embodiment.

Two stability units 30 may be advantageously employed in combination with a binder 10 as shown in FIGS. 6 and 7. In FIG. 6, a binder assembly 20 is secured to a cover of the binder. A stability unit 30 is secured to spine 14 and an identical stability unit, marked 30A is attached to the opposite cover. The binder of FIG. 6 may be locked to both stability unit 30 and 30A. Unit 30A functions to lock adjacent covers together. When unit 30A is unlocked, the binder of FIG. 6 functions like that shown in FIG. 1.

In FIG. 7, a binder assembly 20 is secured to spine 14 and stability units 30 and 30A are secured to adjacent covers. With ring halves 24 locked to both stability units 30, 30A, the opposing covers are locked together. Either of the ring halves may be unlocked from a stability unit, allowing either cover to be free while the other cover remains locked in a right angle to spine 14. Binder 10 may be supported in a upright position with either ring halve locked to a cover.

Stability units 30 may be added to any conventional binder 10 having binder assemblies 20 with arcuate ring halves 24. The stability units 30 may include recesses 34 whose outermost edges have a projection 40 or may simply be formed with a projecting lip such that the distance between the recess walls at the top is greater than at the bottom.

In considering this invention, it must be remembered that the disclosure is illustrative only and that the scope of the invention is determined by the appended claims.

I claim:

1. A loose-leaf binder comprising:

(a) a front cover;

(b) a back cover;

(c) a spine hingedly joined to said back and front covers;

(d) a binder assembly including at least two ring mechanisms, said binder assembly being mounted to one of said covers adjacent said spine; and p1 (e) a stability unit mounted to said spine, said stability unit including a base and an upper portion defining a plurality of ring engaging recesses, each recess having a dimension greater than the diameter of a ring of said ring mechanisms at the bottom of said recess and a dimension at the top of said recess less than said ring diameter such that a ring may be locked within said recess, said upper portion being resiliently deformable such that a ring may temporarily deform the outer walls of a recess when inserted or removed.

2. The loose-leaf binder of claim 1 wherein said stability unit is formed of a resilient plastic.

3. The loose-leaf binder of claim 1 further including a second stability unit mounted to a cover opposed from the cover the binder assembly is mounted thereto such that said covers may be locked together by fitting rings of said binder assembly into recesses of said second stability unit.

4. A loose-leaf binder comprising:

(a) a front cover;

(b) a back cover;

(c) a spine;

(d) hinge means hingedly joining said back and front covers to opposite sides of said spine;

(e) a binder assembly including at least two ring mechanisms, said binder assembly being mounted to said binder adjacent a hinge means; and (f) at least one stability unit, said stability unit including a base and an upper portion defining a plurality of ring engaging recesses, each recess having a dimension greater than the diameter of a ring of said ring mechanisms at the bottom of said recess and a dimension at the top of said recess less than said ring diameter such that a ring may be locked within said recess, each stability unit being mounted to said binder adjacent said hinge means and positioned so that said rings of said ring mechanism may engage with said ring engaging recesses, said upper portion being resiliently deformable such that a ring may temporarily deform the outer walls of a recess when inserted or removed.

5. The loose-leaf binder of claim 4 wherein each stability unit is formed of a resilient plastic.

6. The loose-leaf binder of claim 4 wherein said binder assembly is mounted to said spine and a stability unit is mounted to a cover adjacent a hinge means.

7. The loose-leaf binder of claim 6 further including a second stability unit mounted to an opposing cover adjacent a hinge means.

* * * * *

UNITED STATES PATENT AND TRADEMARK OFFICE

CERTIFICATE OF CORRECTION

PATENT NO. : 4,750,884

DATED : June 14, 1988

INVENTOR(S) : Bourgeois et al

It is certified that error appears in the above-identified patent and that said Letters Patent is hereby corrected as shown below:

Column 4, line 15, "pl" should be deleted.
Column 4, line 15, "(e)" should be the start of a new paragraph on line 16.

Signed and Sealed this

Eighth Day of November, 1988

*Attest:*

DONALD J. QUIGG

*Attesting Officer*

*Commissioner of Patents and Trademarks*